US006129635A

United States Patent [19]

Kuo

[11] Patent Number: 6,129,635

[45] Date of Patent: Oct. 10, 2000

[54] CANOPY FOR A PARACHUTE GAME

[76] Inventor: Eva Kuo, 4F, No. 123-1, Sec. 1, Chung-Te Rd., Pei Dist., Taichung City, Taiwan

[21] Appl. No.: 09/280,636

[22] Filed: Mar. 29, 1999

[51] Int. Cl.[7] ..... A63G 31/00

[52] U.S. Cl. ..... 472/49; 244/155 R

[58] Field of Search ..... 472/49, 50; 446/49; 244/155 R, 145

[56] References Cited

U.S. PATENT DOCUMENTS

| | | | |
|---|---|---|---|
| 2,505,954 | 5/1950 | Frieder et al. | 244/145 |
| 2,730,316 | 1/1956 | Frieder et al. | 244/145 |
| 2,733,028 | 1/1956 | Epple | 244/145 |
| 3,493,199 | 2/1970 | Flatau | 244/145 |

*Primary Examiner*—Kien T. Nguyen
*Attorney, Agent, or Firm*—Ladas & Parry

[57] ABSTRACT

A canopy for a parachute game includes a plurality of flexible sheets of a sectoral shape. Each flexible sheet has two radial side portions and an arcuate portion between the radial side portions. The radial side portions are attached to two adjacent radial side portions of two other flexible sheets respectively so as to form a circular canopy body with a center portion. The arcuate portion has an outer arcuate edge which is disposed distal to the center portion and which defines a cutout portion extending radially towards the center portion. An endless band member is made of a flexible material, and is disposed along the outer arcuate edges of the arcuate portions of the flexible sheets to confine the cutout portions at a side distal to the center portion so as to form hand gripping portions.

1 Claim, 5 Drawing Sheets

CANOPY FOR A PARACHUTE GAME

BACKGROUND OF THE INVENTION

1. Field of the Invention

This invention relates to a canopy for a parachute game, more particularly to a canopy with a plurality of hand gripping portions at outer arcuate edges thereof.

2. Description of the Related Art

Referring to FIGS. 1 and 2, a conventional canopy for a parachute game is shown to include a plurality of flexible sheets 1 of a sectoral shape seamed together to form a circular canopy body 2. A seamed line 3 is disposed on outer arcuate edges 4 of the flexible sheets 1. In use, the players grip the outer arcuate edges 4 and throw the canopy body 2 upwardly to collect air at the bottom side of the latter. However, it is noted that the canopy body 2 is liable to slip away from the players' hands during playing.

SUMMARY OF THE INVENTION

The object of the present invention is to provide a canopy for a parachute game which facilitates firm gripping of the same when playing.

According to this invention, the canopy includes a plurality of flexible sheets of a sectoral shape. Each flexible sheet includes two radial side portions and an arcuate portion. The radial side portions of each flexible sheet are attached to two adjacent radial side portions of two other flexible sheets respectively so as to form a circular canopy body with a center portion which is located at a site where extended lines of the radial side portions meet. The arcuate portion is disposed between the radial side portions and is opposite to the center portion in a radial direction. The arcuate portion has an outer arcuate edge which is disposed distal to the center portion and which defines a cutout portion extending radially towards the center portion. An endless band member is made of a flexible material, and is disposed along the outer arcuate edges of the arcuate portions of the flexible sheets to confine the cutout portions at a side distal to the center portion so as to form hand gripping portions.

Preferably, a cuff member is made of a flexible material, and is disposed along peripheries which define the cutout portions distal to the center portion so as to reinforce the peripheries.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
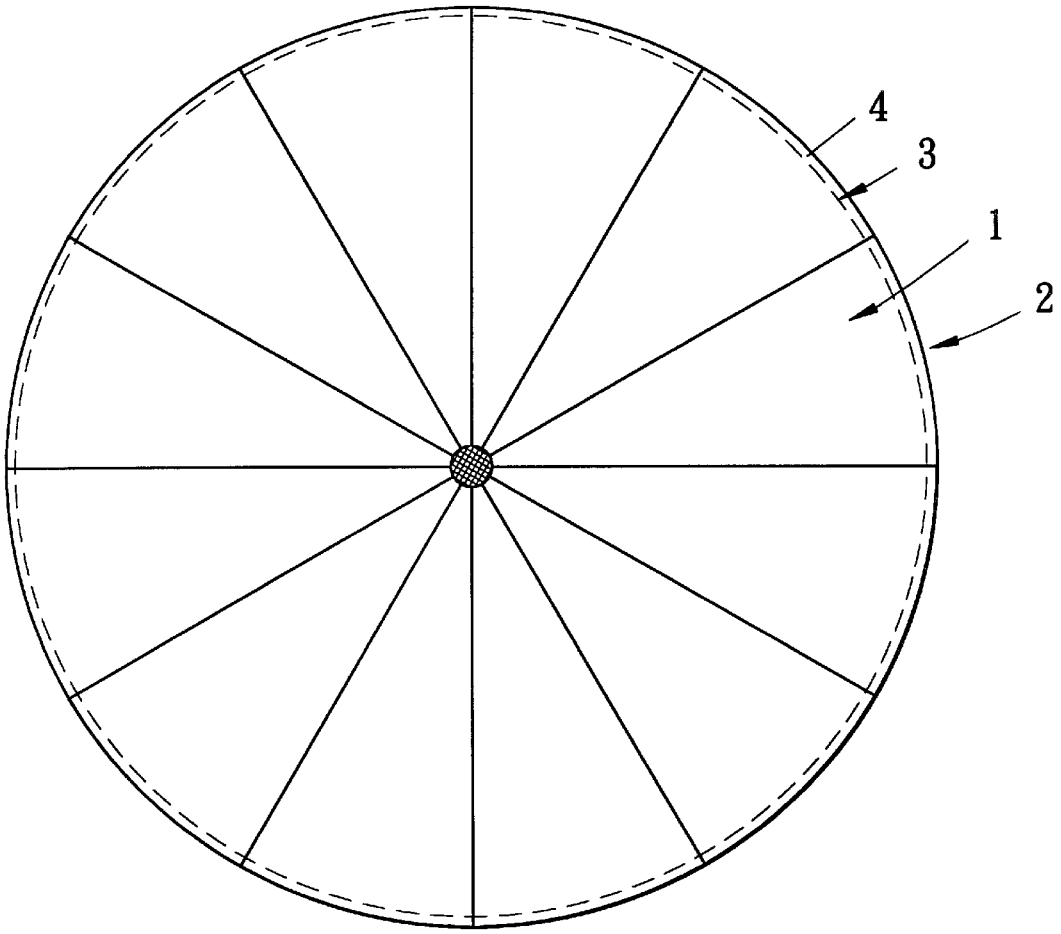
FIG. 1 PRIOR ART
FIG. 1 is a top view of a conventional canopy for a parachute game.
Figure 2:
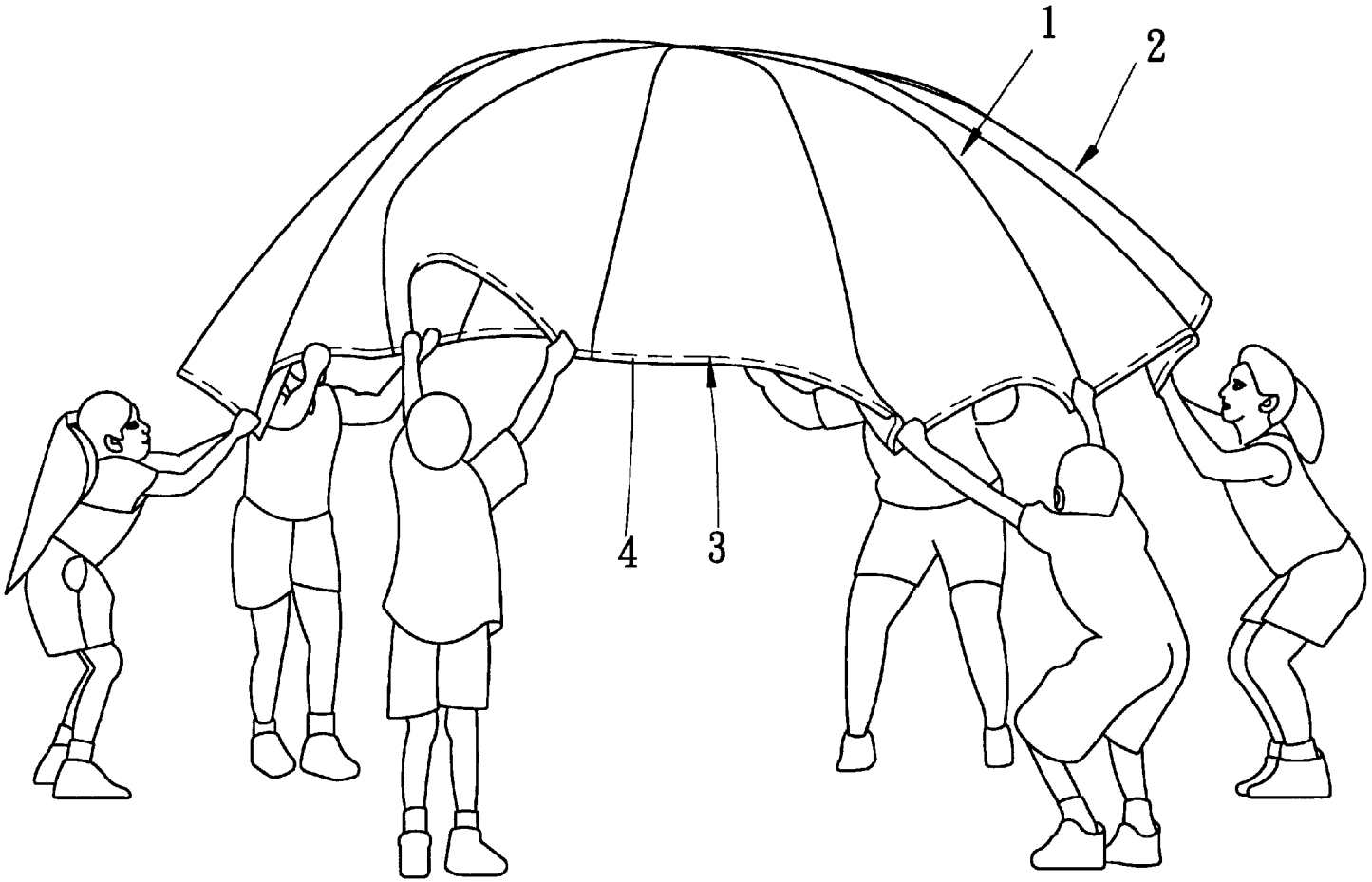
FIG. 2 PRIOR ART
FIG. 2 is a schematic view of the conventional canopy when in use.

Before the present invention is described in greater detail, it should be noted that same reference numerals have been used to denote like elements throughout the specification.

Figure 3:
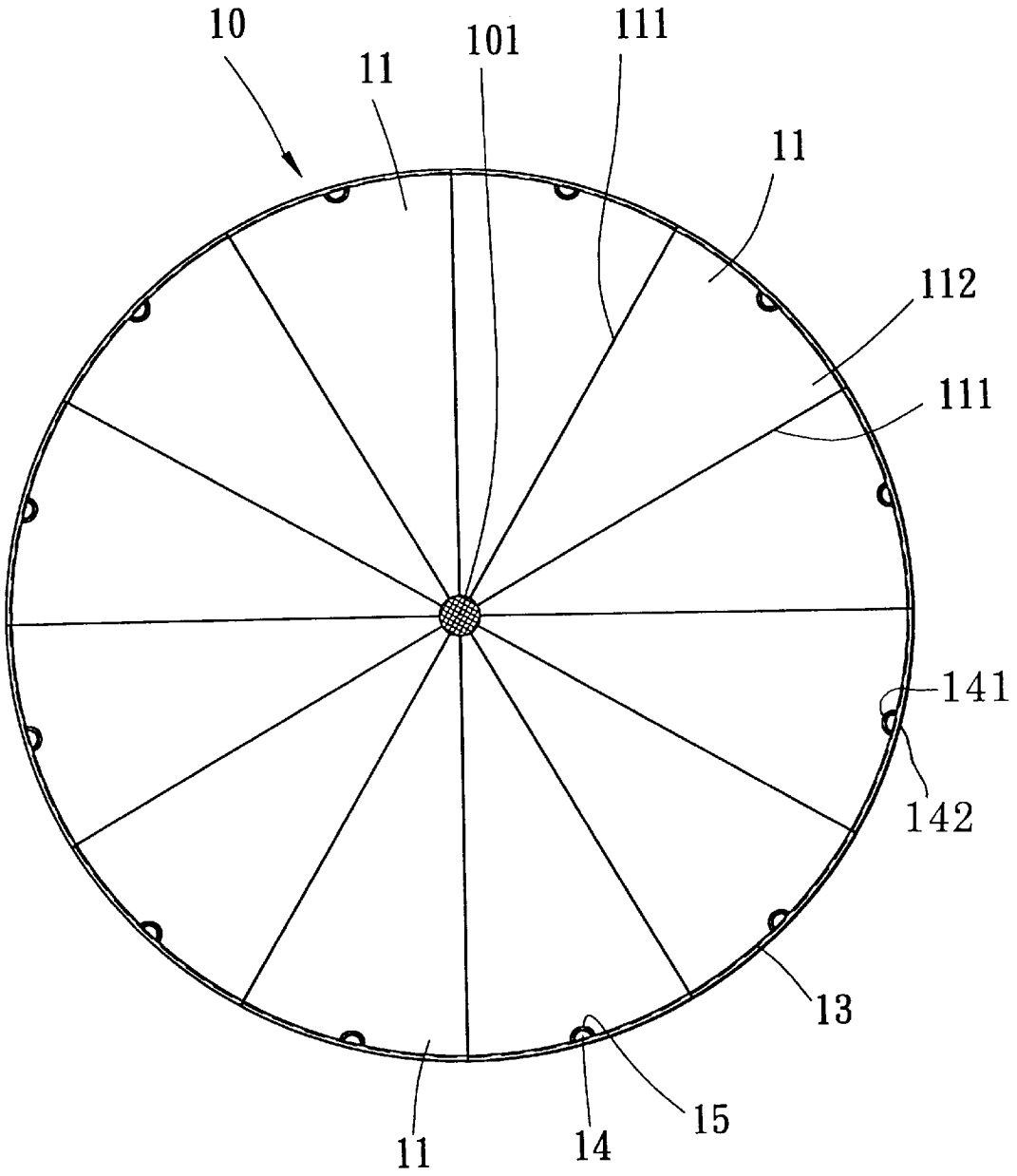
FIG. 3 is a top view of a first preferred embodiment of a canopy according to this invention.
Figure 4:
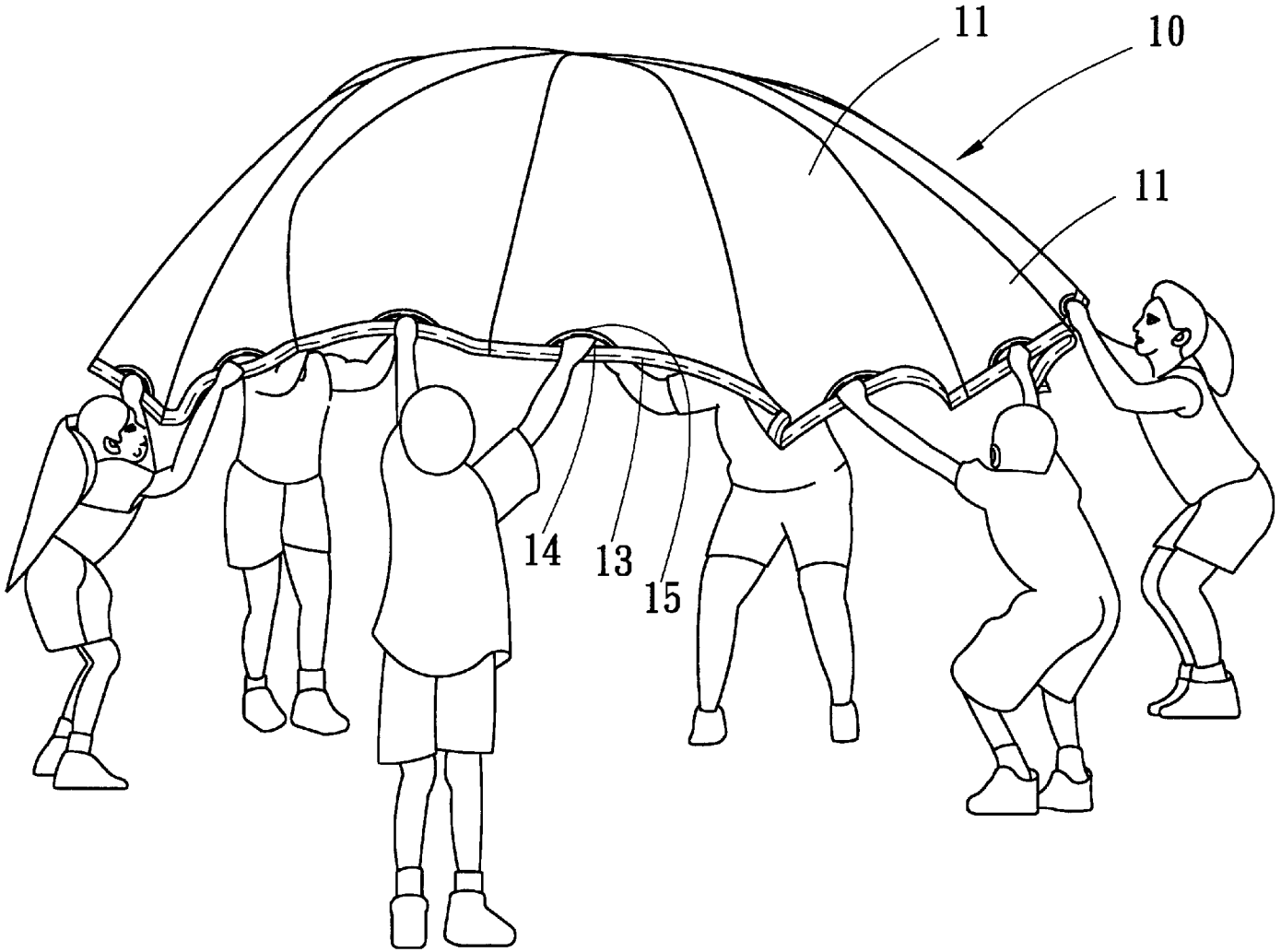
FIG. 4 is a schematic view of the first preferred embodiment when in use.

Referring to FIGS. 3 and 4, the first preferred embodiment of the canopy for a parachute game according to the present invention is shown to comprise four flexible sheets 11 of a sectoral shape. The flexible sheets 11 are differently coloured, such as red, green, yellow and blue. Each flexible sheet 11 includes two radial side portions 111 and an arcuate portion 112 which is disposed between the radial side portions 111. The radial side portions 111 are attached to two adjacent radial side portions 111 of two other flexible sheets 11 that are respectively adjacent thereto so as to form a circular canopy body 10 with a center portion 101 that is located at a site where extended lines of the radial side portions 111 meet. The arcuate portion 112 is disposed opposite to the center portion 101, and includes an outer arcuate edge which is disposed distal to the center portion 101 and which defines a cutout portion 14 that extends radially toward the center portion 101 to form a radially and inwardly indented edge 141 that borders arcuate portion 112, and an interrupted portion 142 that interrupts the continuity of the arcuate shape of the outer arcuate edge An endless band 13 is made of a flexible material different from the flexible sheets 11, such as polypropylene, and is disposed along the outer arcuate edges of the arcuate portions 112 of the flexible sheets 11 to confine each of the cutout portions 14 at a side distal to the center portion 101 so as to form a hand gripping portion.

A cuff member 15 is made of a flexible material different from the flexible sheets 11, such as polypropylene, and is disposed along a periphery of each cutout portion 14 distal to the center portion 101.

Referring to FIG. 4, by virtue of the hand gripping portions, the players can grip the canopy body 10 very firmly to prevent the latter from slipping out of the player's hands during playing. In addition, the cuff members 15 can reinforce the peripheries of the cutout portions 14.

Figure 5:
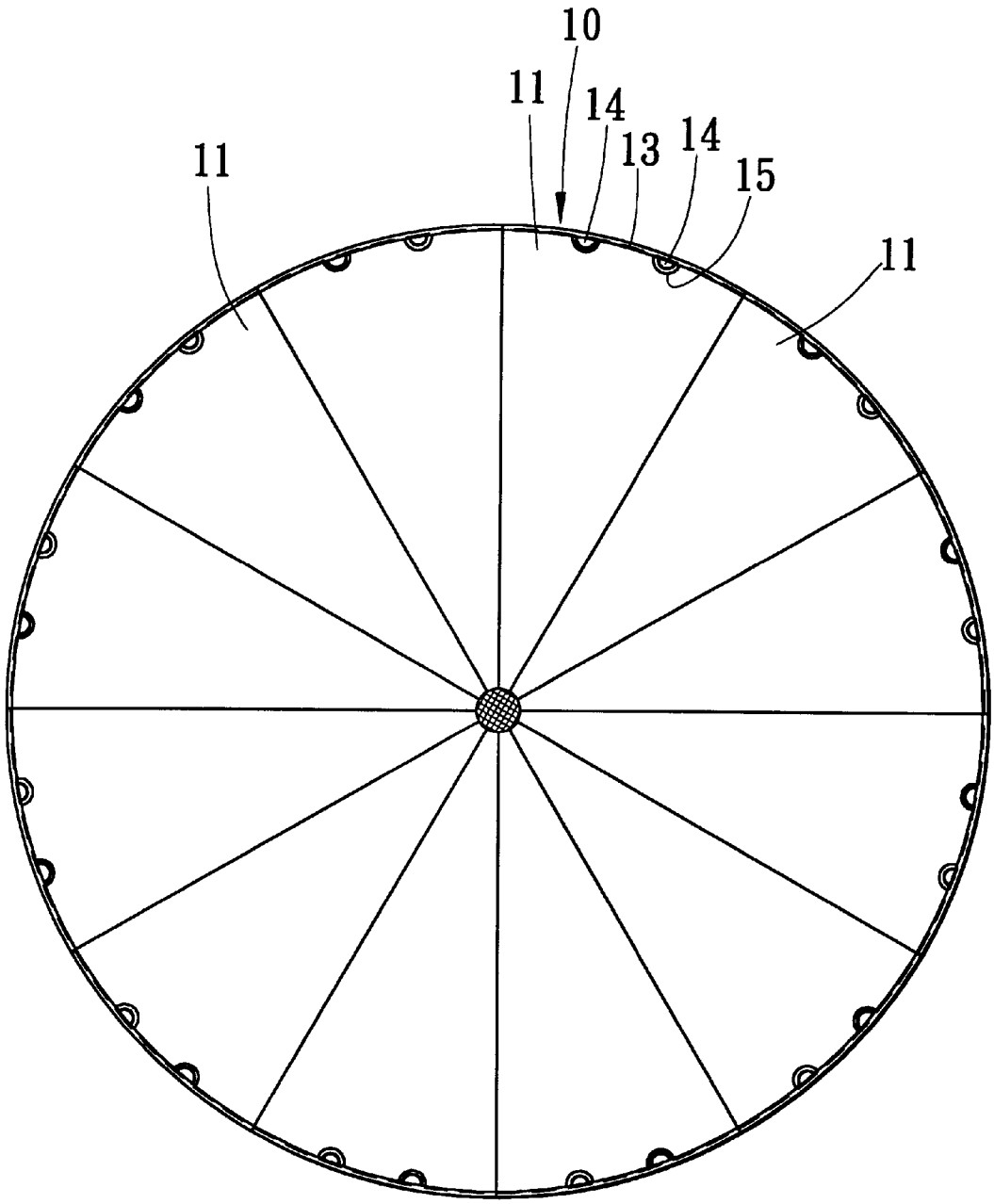
FIG. 5 is a top view of a second preferred embodiment of a canopy according to this invention.

FIG. 5 shows the second preferred embodiment of this invention, wherein each flexible sheet 11 has two cutout portions 14 at the outer arcuate edge thereof.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A canopy for a parachute game, comprising:

a plurality of flexible sheets of a sectoral shape, each including:

two radial side portions attached to two adjacent ones of said radial side portions of two other ones of said flexible sheets that are respectively adjacent thereto so as to form a circular canopy body with a center portion located at a site where extended lines of said radial side portions meet;

an arcuate portion disposed between said radial side portions and opposite to said center portion in a radial direction, said arcuate portion including an outer arcuate edge which is disposed distal to said center portion and which defines a cutout portion extending radially towards said center portion to form a radially and inwardly indented edge that borders said arcuate portion and an interrupted portion that interrupts the continuity of an arcuate shape of said outer arcuate edge; an endless band member made of a flexible material, and disposed along said outer arcuate edge of said arcuate portion to confine said interrupted portion of said cutout portion so as to form a hand gripping portion; and a cuff member made of a flexible material, and disposed along said indented edge so as to reinforce said indented edge.

* * * * *